US005435610A

United States Patent [19]

Roberts

[11] Patent Number: 5,435,610

[45] Date of Patent: Jul. 25, 1995

[54] SUBFLOOR PANEL DRIVING DEVICE AND METHOD

[75] Inventor: Michael T. Roberts, Riverdale, Utah

[73] Assignees: Charles Taylor, Tremonton; Wheatland Seed, Inc., Brigham City, both of Utah

[21] Appl. No.: 214,439

[22] Filed: Mar. 18, 1994

[51] Int. Cl.[6] ..... B25B 27/02

[52] U.S. Cl. ..... 294/15; 29/278; 254/11

[58] Field of Search ..... 294/15, 19.1; 29/278; 15/235.4, 235.8, 145; 254/11, 15, 17

[56] References Cited

U.S. PATENT DOCUMENTS

| | | | |
|---|---|---|---|
| 1,188,167 | 6/1916 | Foucart | 294/15 X |
| 1,461,991 | 7/1923 | Walker | 254/11 |
| 2,550,096 | 4/1951 | Strandberg | 254/15 |
| 3,049,336 | 8/1962 | Proffit | 29/278 X |
| 3,758,909 | 9/1973 | Granger, Jr. | 15/235.8 |
| 3,939,546 | 2/1976 | Hernandez | 294/15 X |
| 4,683,631 | 8/1987 | Dobbertin | 29/278 |
| 4,695,085 | 9/1987 | Cassels . | |
| 4,702,641 | 10/1987 | Naser et al. | 15/235.8 X |
| 5,248,127 | 9/1993 | Young | 254/15 |
| 5,257,843 | 11/1993 | Nunn . | |

*Primary Examiner*—Dean J. Kramer
*Attorney, Agent, or Firm*—Mallinckrodt & Mallinckrodt

[57] ABSTRACT

The device and method of the invention enables a single workman to drive a tongue and groove subflooring panel into mating connection with a prelaid subfloor panel without the use of a sledgehammer. The device fits over and receives and is secured to the usual driving plank as an operative part thereof. An elongate handle extends upwardly and backwardly at an acute angle to and from its lower end portion, which is fastened to the upper face of the plank centrally and transversely thereof so the workman standing on the panel facing forwardly with his legs spread apart longitudinally therealong uses his weight to flatten the panel while he forcefully pulls the device backwardly, so the driving plank, whose rearward longitudinal edge face abuts the grooved forward edge face of the subfloor panel to be driven, drives such subfloor panel into mated connection with a rearwardly positioned, prelaid, subfloor panel. Relatively widely spaced, laterally of the handle at opposite sides thereof, the device is reinforced and stabilized by structure that is fastened flatwise to the driving plank and that extends backwardly with the handle at a similar acute angle from the driving plank.

11 Claims, 2 Drawing Sheets

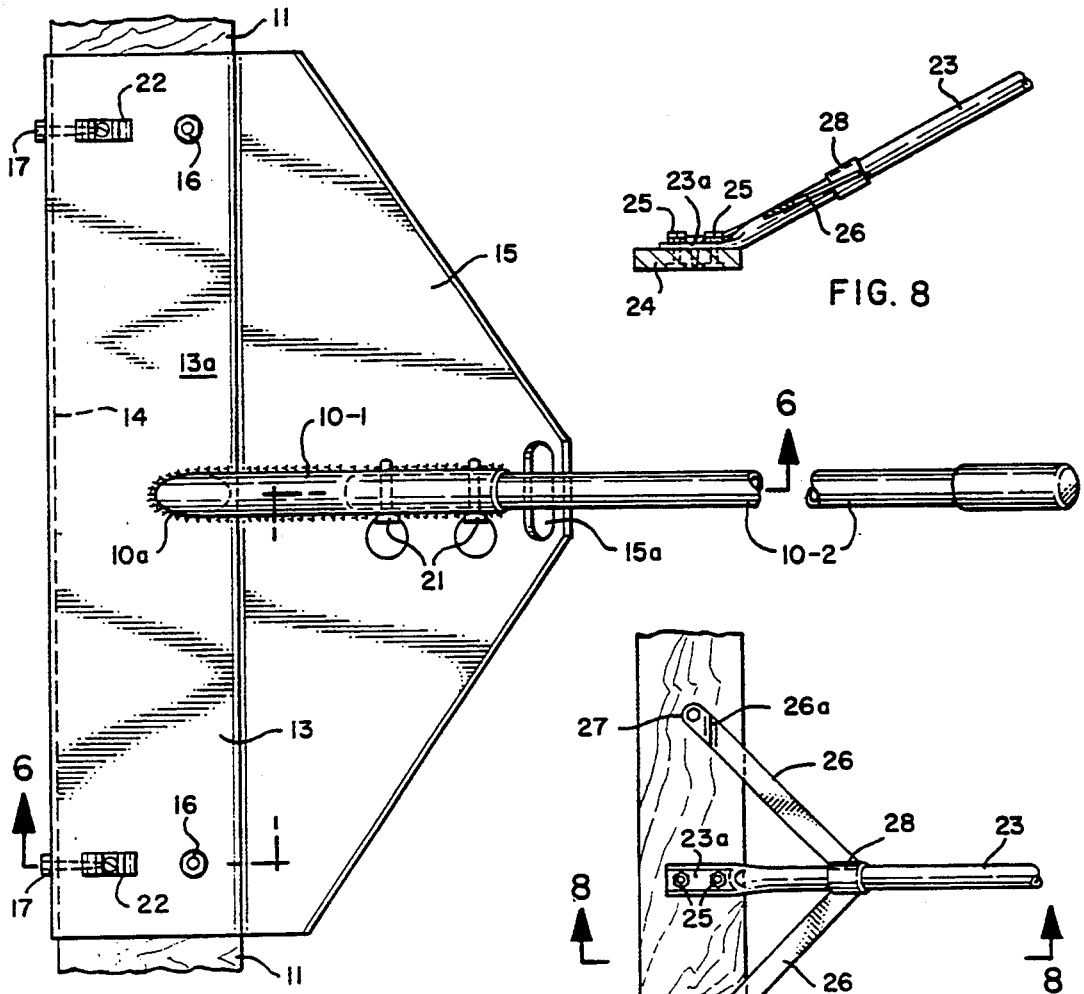
FIG. 5
FIG. 8
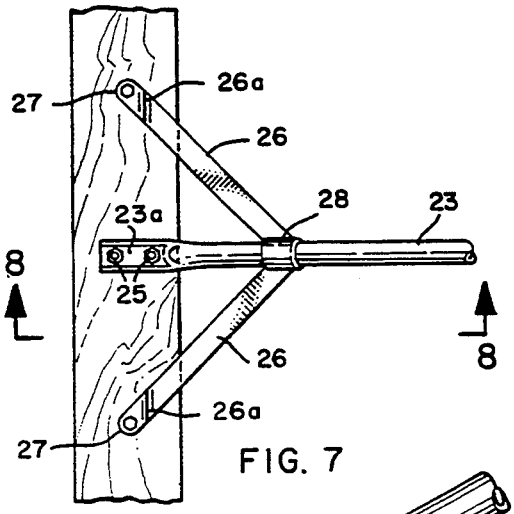
FIG. 7
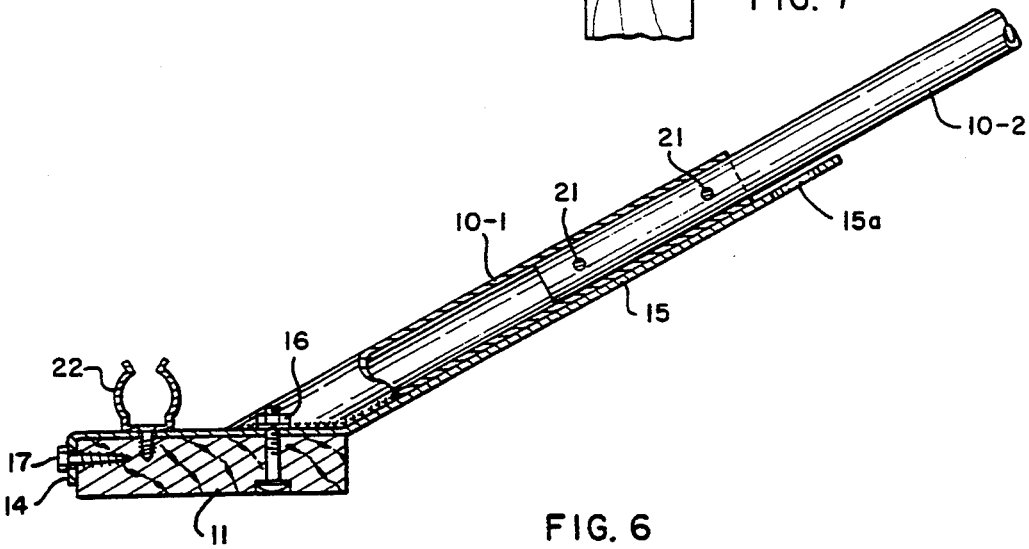
FIG. 6

SUBFLOOR PANEL DRIVING DEVICE AND METHOD

BACKGROUND OF THE INVENTION

1. Field

The invention is in the field of manually operated devices and of methods for applying driving force to structural components of buildings during construction of the buildings.

2. State of the Art

A variety of manually operated devices have been developed for applying force to various structural components used in the construction industry, the simplest and best known being hammers for driving nails. When occasion has warranted, hammers have been employed for exerting driving force on other structural components, most recently in the driving of tongue and groove subflooring panels into mated interconnecting relationship in the laying of floors in the construction of dwelling houses and other buildings. Thus, it is almost universally the practice among building contractors and skilled workmen, such as carpenters, to drive the rather large panels of tongue and groove plywood used for subflooring by pounding with a sledgehammer on the free longitudinal edge face of a plank that is laid next to the grooved longitudinal edge face of the panel to be driven. Both panel and plank lie flatwise across a series of floor joists, a longitudinal edge face of the plank confronting the grooved longitudinal edge face of the panel. Pounding on the free longitudinal edge face of the plank drives the tongue of the opposite longitudinal edge face of the panel into the groove of the confronting longitudinal edge face of an already laid panel of such subflooring.

This has had its difficulties due to the length and width dimensions of standard sized panels of plywood (normally 8 feet by 4 feet) and by the tendency for such panels to be somewhat warped as supplied to the builder. In general, it has required the combined efforts of three men to successfully and satisfactorily accomplish the close interfitting relationship of tongue and groove required for a smooth floor. One man in the middle wields the sledgehammer, while the other men stand on or near opposite ends of the panel to be added, so as to flatten such panel against the floor joists as it is being driven into place.

SUMMARY OF THE INVENTION

Applicant has recognized the above-noted difficulties and the need for a better method of accomplishing the task, as well as for a device that would eliminate the use of a sledgehammer.

Accordingly, in the making of the present invention the need for more than one workman to do the job was eliminated by the conception, construction, and use of a driving device that enables a single workman to stand on and span with his legs much of the length of the panel while driving the thus flattened panel into place by pulling force exerted against a plank positioned as previously done but being received by and held as part of a device of the invention.

The basic form of the device of the invention comprises an elongate handle formed at its lower end, whether such lower end is a rectilinear part of a wholly rectilinear handle length or is divided into two or more laterally spaced members, for connection to a driving plank at an acute angle to the horizontal, so the handle length extends from the received plank at least partially along a longitudinal axis that is substantially normal to the longitudinal axis of the plank.

For receiving the plank, the basic form of the device of the invention may comprise an elongate handle having a substantially rectilinear, longitudinal axis with a lower end portion formed on a plane at a substantially 180° angle to the longitudinal axis of the length of the handle for flatwise connection to the upper flat surface of a received driving plank. Supplemental plank attachment and stabilizing means is preferably provided extending backwardly of and alongside the handle at opposite sides thereof, respectively, from relatively widely spaced lateral locations alongside the angled end portion of the handle to a backward location along the length of the handle. Such attachment and stabilizing means have forwardly placed, end portions angled for flatwise attachment to the upper flat surface of the received driving plank.

The presently preferred way of making the plank-receiving device as above described is to provide an elongate hood for receiving and fitting over a driving plank, with the angled lower end portion of the handle rigidly fastened to the top of the hood, centrally thereof, so the remaining length of the handle extends backwardly and upwardly, substantially normal to the length of the hood and at an acute angle thereto. Preferably, a flat plate member extends backwardly from and longitudinally along the rearward edge of the hood at substantially the same acute angle as does the handle, with opposite lateral ends of such plate and the hood providing the supplemental plank attachment and stabilizing means. The hood preferably includes a forward, downturned lip extending longitudinally thereof for abutting against the confronting forward, longitudinal edge face of a received plank to better exert driving force on the plank as the device is pulled by the workman, who would formerly be using a sledgehammer against such forward longitudinal edge face of the driving plank.

A less desirable way of making the plank-receiving device of the invention is to provide the elongate handle with its angled lower end provided by two or, more laterally spaced members adapted for attachment to the upper surface of a received plank, with or without a hood, which laterally spaced members provide a pair of plank attachment and stabilizing bars having their lower ends similarly acutely angled and relatively widely spaced for flatwise attachment to the upper longitudinal face of a plank at opposite lateral sides of the handle, respectively, and sloping upwardly and backwardly toward the handle and secured thereto at a backward location thereon intermediate the length thereof.

This later arrangement suffers by not having the aforementioned flat plate extending upwardly and backwardly as a runner for the device when it is at the end of prelaid joists for driving the final subfloor panel or partial panel in the finishing of a subfloor area of a building, but such a plate can be supplied between or overlapping the side bars and with its own longitudinally extending, angled foot for attachment to the upper surface of a received, driving plank.

In either embodiment, it is preferred to construct the device for easy carrying, with or without a received plank, by making the elongate handle in two separate, longitudinal pieces for rigid interconnection. Carrying clips for the upper extension part of the handle may be provided on the upper surface of the hood, if provided, as well as a carrying slot for accommodating a hand of the user at the upper end of the flat plate member, if provided.

THE DRAWINGS

Illustrated in the accompanying drawings as the best modes presently contemplated for carrying out the invention in actual practice are the afore-indicated embodiments of the invention wherein:

FIG. 1 represents a pictorial view of the preferred form of the device equipped with a plank-receiving hood and shown in use with a driving plank installed as part of the device;

FIG. 2, a similar view in side elevation but drawn to a reduced scale;

FIG. 3, a fragmentary view of the detail encircled by the line 3 in FIG. 2 but drawn to a considerably larger scale;

FIG. 4, a pictorial view of the device of the foregoing figures disassembled for convenient carrying to the work place;

FIG. 5, a top plan view of the device as shown in FIG. 1 but per se and foreshortened for convenience of illustration;

FIG. 6, a longitudinal vertical section taken along the line 6—6 of FIG. 5;

FIG. 7, a view corresponding to that of FIG. 5 but drawn to a reduced scale and showing the less preferred embodiment; and FIG. 8, a view corresponding to that of FIG. 6 but with respect to the embodiment of FIG. 7.

DETAILED DESCRIPTION OF THE ILLUSTRATED EMBODIMENT

Figure 1:
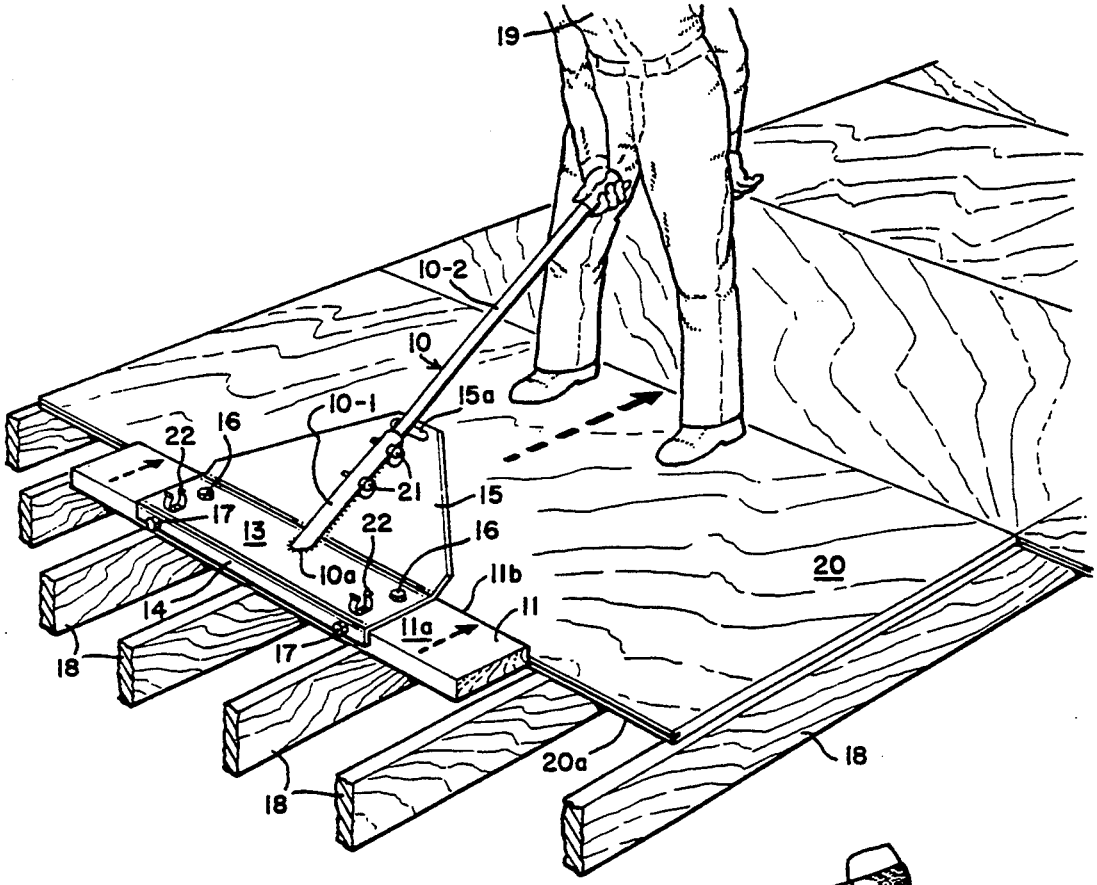
Figure 2:
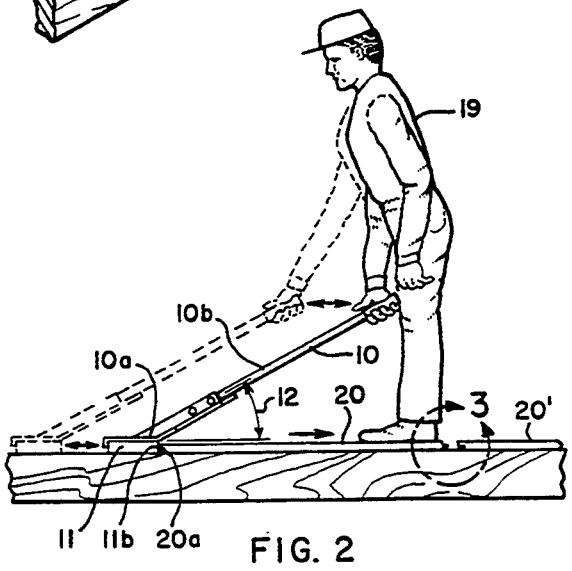

As shown in FIGS. 1–6, the presently preferred embodiment of the invention comprises an elongate handle 10 that is preferably formed from a rectilinear length of lightweight structural tubing, such as aluminum, the lower end 10a of which is formed on a plane at an acute angle (preferably twenty eight degrees on thereabouts) to the longitudinal axis 10*b*, FIG. 2, of the length of such handle 10, for attachment to the flat top 11*a* of a received driving plank 11 at an acute angle 12.

Figure 4:
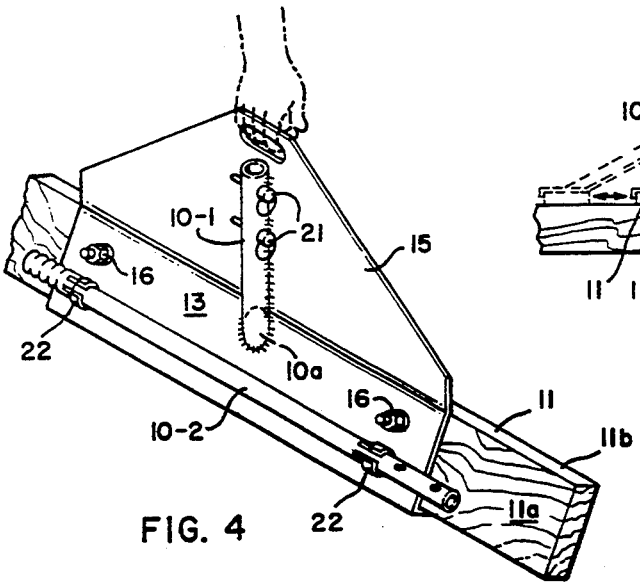
Figure 3:
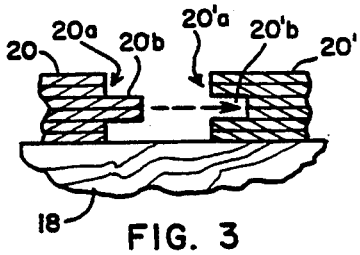

As previously indicated, such plane-formed lower end 10*a* of handle 10 is preferably secured, as by welding, to the upper surface 13a an elongate hood 13, so the acute angle 12 is between such upper 13*a* of the hood and the longitudinal axis 10*b* of tubular handle 10. Hood 13 is elongate and preferably formed flat of sheet aluminum to receive and fit flatwise over the upper surface of a driving plank, represented here by the driving plank 11. Hood 13 also preferably has a forward, downturned lip 14 and a rearward, upturned flat plate extension 15, the entire hood as so constituted being conveniently formed by bending a sheet of aluminum, that has been cut to shape and size for the purpose and provided with holes for receiving plank-attaching lag screws 16. Handle 10 is desirably welded to plate extension 15 of the hood as indicated in FIGS. 1, 4, and 5.

It should be noted that the placements indicated in terms of direction have reference to users of the device and the positions assumed by the device during use and are indicative of the close tie in of both the apparatus and the procedural aspects of the invention presented and claimed herein.

In using the device of the invention, a driving plank, 11, must be inserted in the basic receiving device of the invention, which device may be made available commercially without the plank that is obtainable by the user from any lumber yard and is very heavy such as to preclude its being furnished as a part of the basic device. Thus, such a basic device must be fastened to a plank for use, as by sets of bolts 16 and lag screws 17. Then, it must be placed on and across floor joists 18, FIGS. 1 and 2, with the plank resting flatwise on such floor joists so that handle 10 extends rearwardly toward a workman 19 transversely across a subfloor panel 20 that is to be driven into tongue and groove interconnection with a therefrom-spaced, similar, prelaid floor panel 20, see FIG. 2. The rearward edge face 11*b* of received plank 11 confronts the grooved edge face 20*a* of the to-be-driven subfloor panel 20, whose tongued edge face confronts and is slightly spaced from, see FIGS. 2 and 3, or even against, prelaid panel 20', with tongue 20*b* directed toward groove 20'*b* of the confronted face 20'*a* of prelaid panel 20'.

By pulling driving plank 11, as from the forwardly spaced position relative to panel 20 shown by broken lines in FIG. 2, toward and against the grooved edge face 20'*a* of panel-to-be-driven 20, repeatedly if need be, tongue 20*b* is driven into groove 20'*b* of prelaid panel 20'. The workman 19 using the device stands astride panel-to-be-driven 20 longitudinally thereof, somewhat as shown in FIG. 1, for effectively flattening against floor joists 12 any warpage that might otherwise interfere with entry of tongue 20*b* into groove 20'*b*.

For convenience and ease of carrying the device, with or without driving plank attached, see FIG. 4, it is preferred that handle 10 be made of separate but interconnectable, lower and upper parts 10-1 and 10-2, respectively, as by telescopic interfitting, with the upper end of plate 15 being provided with a hand-hold 15*a*, see also FIGS. 1, 5, and 6. The two telescopic sections of handle 10 may be removably secured together for use of the device as by means of bolts 21. A set of mutually spaced, spring clips 22 may be secured to the upper face of hood 13 for receiving upper handle section 10-2, as in FIGS. 1 and 4.

The less preferred embodiment of the invention illustrated in FIGS. 7 and 8 comprises a rectilinear elongate handle 23 corresponding to the handle 10 as being entirely rectilinear along its length but with the lower end portion 23*a* flattened and bent angularly to the longitudinal axis of the remaining length of the handle so as to be capable of being fastened flatwise directly to the upper surface of a plank 24 by means of bolts 25, FIG. 8, or to a hood as shown in the earlier described embodiment. Attachment and stabilizing means, conveniently in the form of flat, structural strips 26, extending at opposite sides, respectively, and backwardly along handle 23 from forward ends 26*a* that are bent angularly to the longitudinal axis of handle 23 as is the bent lower end portion 23*a* of handle 23 and fastened flatwise, as by bolts 27 to the upper surface of plank 24 alongside, but relatively widely spaced from, the bent lower end portion 23*a* thereof, so as to extend diagonally backwardly alongside handle 23 at obtuse and acute angles relative to said handle. Such attachment and reinforcing strips 26 are similarly conveniently fastened to handle 23 by rigid connection thereto, and their rearward ends are desirably fastened to a relative short, tubular member 28 that is, itself, rigidly fastened to handle 23 in any suitable manner as, for example, by welding.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A device for enabling the driving, by a single workman standing behind the device, of panels of tongue and groove subflooring into interconnected relationship without the use of a sledgehammer, comprising an elongate handle formed at its lower end for connection to a driving plank at an acute angle to the horizontal, so the handle length extends from the received plank at least partially along a longitudinal axis that is substantially normal to the longitudinal axis of the plank;

an elongate hood that is adapted to receive and to fit longitudinally over and along the plank and to which the lower end of the handle is connected; and a flat plate extending backwardly from and longitudinally along securement to the rearward edge of the hood at substantially the same angle to the horizontal as does the handle from its lower end.

2. A device according to claim 1, including stabilizing means extending alongside said handle at opposite sides thereof, respectively, from respective lateral locations alongside the lower end of the handle to a rearward location along the length of the handle, said stabilizing means having lower end portions angled as is the said lower end of the handle for connection to the driving plank.

3. A device according to claim 2, including the plank as part of the device.

4. A device according to claim 1, wherein the acute angle is approximately twenty eight degrees.

5. A device according to claim 4, including the plank as part of the device.

6. A device according to claim 1, including the plank as part of the device.

7. A device according to claim 1, wherein at least the upper portion of the length of the handle is rectilinear and is a separate part of said handle adapted to be separately attached to the lower portion of the length of the handle; and wherein temporary holding means for one of said portions of the length of the handle is provided on the other of said portions of the length of the handle.

8. A device for enabling the driving, by a single workman standing behind the device, of panels of tongue and groove subflooring into interconnected relationship without the use of a sledgehammer, comprising an elongate, substantially rectilinear handle having an end formed for attachment on a plane of substantially 180° at respective obtuse and acute angles, to the length of the handle to and substantially centrally of an upper flat surface of an elongate driving plank, substantially normal to the length of said plank;

an elongate hood adapted to receive and fit over and to extend longitudinally of the upper surface of the driving plank and having a substantially flat plate extending backwardly from securement to and longitudinally along the rearward longitudinal edge of the hood at substantially the same angularity as does the handle from its said end;

and supplemental plank attachment and stabilizing means extending alongside said handle at opposite sides thereof from respective, relatively widely spaced locations laterally of said end of the handle to a location along the length of the handle, said attachment and stabilizing means having lower end portions attached to said hood, the lower end portions of the attachment and stabilizing means comprising respective opposite ends of said backwardly extending plate.

9. A device according to claim 8, wherein the lower end of the handle is plane-formed and is attached flatwise to the upper flat surface of the elongate hood that is adapted to receive and fit flatwise over and to extend longitudinally of the upper surface of the plank, the lateral sides of said hood and of said plate constituting the attachment and stabilizing means.

10. A device according to claim 8, wherein the hood includes a forward, downturned lip extending longitudinally thereof for abutting against the forward longitudinal edge face of the received plank to enhance pulling force on the received plank when the handle is pulled.

11. A device according to claim 8, including an elongate driving plank; and means rigidly attaching the plane-formed end of the elongate handle to said driving plank so the plank becomes part of the device.

* * * * *